US008393115B2

(12) United States Patent
Schroder et al.

(10) Patent No.: US 8,393,115 B2
(45) Date of Patent: Mar. 12, 2013

(54) WEATHER SEAL SYSTEM

(75) Inventors: Paul D. Schroder, Pella, IA (US); Joseph A. Ritzert, Pella, IA (US)

(73) Assignee: Pella Corporation, Pella, IA (US)

( * ) Notice: Subject to any disclaimer, the term of this patent is extended or adjusted under 35 U.S.C. 154(b) by 451 days.

(21) Appl. No.: 12/553,595

(22) Filed: Sep. 3, 2009

(65) Prior Publication Data

US 2011/0047884 A1 Mar. 3, 2011

(51) Int. Cl.
*E06B 1/70* (2006.01)

(52) U.S. Cl. ..... 49/469; 49/504; 49/495.1; 52/207; 52/212

(58) Field of Classification Search ..... 49/467, 49/468, 469, 470, 504, 366, 495.1; 52/204.51, 52/211, 212, 207, 717.01
See application file for complete search history.

(56) References Cited

U.S. PATENT DOCUMENTS

| | | | | | |
|---|---|---|---|---|---|
| 3,851,420 | A | | 12/1974 | Tibbetts | |
| 4,055,917 | A | | 11/1977 | Coller | |
| 4,185,416 | A | | 1/1980 | Wilmes | |
| 4,237,664 | A | | 12/1980 | Wilmes | |
| 4,310,991 | A | * | 1/1982 | Seely | 49/470 |
| 4,447,987 | A | * | 5/1984 | Lesosky | 49/468 |
| 4,660,338 | A | * | 4/1987 | Wagner | 52/232 |
| 4,831,779 | A | | 5/1989 | Kehrli et al. | |
| 4,837,977 | A | * | 6/1989 | Mauro | 49/501 |
| 4,891,921 | A | | 1/1990 | Governale | |
| 4,974,364 | A | * | 12/1990 | Durham, Jr. | 49/400 |
| 4,974,366 | A | * | 12/1990 | Tizzoni | 49/504 |
| 5,018,307 | A | * | 5/1991 | Burrous et al. | 49/471 |
| 5,081,793 | A | * | 1/1992 | Mauro | 49/501 |
| 5,174,065 | A | * | 12/1992 | Schlicht | 49/489.1 |
| 5,179,804 | A | | 1/1993 | Young | |
| 5,341,600 | A | | 8/1994 | Heppner | |
| 5,371,987 | A | * | 12/1994 | Hirsch et al. | 52/207 |
| 5,687,508 | A | | 11/1997 | Fitzhenry, Jr. et al. | |
| 5,870,859 | A | | 2/1999 | Kitada | |
| 6,219,971 | B1 | * | 4/2001 | Headrick | 49/469 |
| 6,367,201 | B1 | * | 4/2002 | Massey et al. | 49/467 |
| 6,374,545 | B1 | * | 4/2002 | Baczuk | 49/470 |
| 6,665,989 | B2 | * | 12/2003 | Bennett | 52/287.1 |
| 7,263,808 | B2 | | 9/2007 | Massey et al. | |
| 7,266,929 | B1 | | 9/2007 | Allred et al. | |
| D588,905 | S | | 3/2009 | Meeks et al. | |
| 7,905,058 | B2 | * | 3/2011 | Massey et al. | 49/365 |
| 2006/0150521 | A1 | | 7/2006 | Henry et al. | |
| 2007/0227076 | A1 | | 10/2007 | Braun | |
| 2008/0120914 | A1 | * | 5/2008 | Fink et al. | 49/469 |
| 2009/0038231 | A1 | | 2/2009 | Erbrect et al. | |

OTHER PUBLICATIONS

Andersen® Frenchwood® Hinged Patio Doors, 400 Series, Architectural Detail File, marked Rev. Mar. 2005, 21 pages.
Chapter 12, Clad Ultimate Inswing French Door, Marvin Architectural Detail Manual No. 11708608, marked with various dates, 42 pages.

(Continued)

*Primary Examiner* — Jerry Redman
(74) *Attorney, Agent, or Firm* — Faegre Baker Daniels LLP

(57) ABSTRACT

Some aspects relate to weather seal systems for forming water barriers and air barriers. Some air barriers include a sill portion, a frame portion, and a transition portion extending between the sill and frame portions, where the transition portion extends inwardly and downwardly from the frame portion of the air barrier, toward an interior side of an associated door assembly, to the sill portion of the air barrier. The transition portion optionally provides a buffer zone, or transition zone of air at a greater spacing from the water barrier. In some embodiments, the transition zone is equilibrated to external pressures and supplies substantially dry air to air leaks in the air barrier.

21 Claims, 13 Drawing Sheets

OTHER PUBLICATIONS

Installation Guide for Andersen® 400 Series Frenchwood® Hinged Patio Doors or 400 Series Frenchwood® Hinged Patio Doors with Stormwatch® Protection, Instruction Guide 0004234 BB, © 1997-2008, marked Revised Apr. 29, 2008, 12 pages.

Installation Instruction—Premium Wood Entry Door, Part No. E829300, © 2008 Pella Corporation, 6 pages.

Ramped Sill Insert for Andersen® Patio Doors, Instruction Guide 0004392, © 1996-2004, marked Revised Apr. 13, 2004, 6 pages.

Tru-Defense® Door System, © 2009 Therma-Tru, downloaded from http://www.thermatru.com, 1 page.

* cited by examiner

WEATHER SEAL SYSTEM

BACKGROUND

In order to reduce the likelihood of moisture ingress into a dwelling or other structure, exterior door assemblies include sealing systems (e.g., gaskets, flanges, and the like) between the door and door frame. As one might expect, moisture intrusion is more problematic in high moisture situations with relatively increased exterior pressure (e.g., as is the case near oceans or in storms due to wind and moist air). In the past, in order to combat moisture ingress, various solutions requiring raised and/or moisture-wicking sills have been implemented.

SUMMARY

Some embodiments relate to a weather seal system forming a water barrier and an air barrier. In some embodiments, the air barrier includes a sill portion, a frame portion, and a transition portion extending between the sill and frame portions. The transition portion extends inwardly and downwardly from the frame portion of the air barrier, toward an interior side of an associated door assembly, to the sill portion of the air barrier. At the corners of the door assembly, the transition portion optionally provides a buffer zone, or transition zone of air at a greater spacing from the water barrier. In some embodiments, the transition zone supplies substantially dry air to any air leaks in air barrier at the lower corner(s) of the door assembly.

Some embodiments relate to a door assembly including a frame, a door, a first side seal, a lower seal and a first transition seal. The frame includes a top portion, a bottom portion, a first side portion, and a second side portion opposite the first side portion. The door is secured to the frame and has a top, a bottom, a first side, a second side opposite the first side, a front, and a back. The first side has a front portion toward the front of the door and a back portion toward the back of the door. The bottom has a front portion toward the front of the door and a back portion toward the back of the door. The first side seal is adapted to be secured substantially vertically between the first side portion of the door frame and the first side of the door and to contact the first side portion of the door frame and the first side of the door to form a first weather barrier toward the front portion of the first side of the door. The lower seal is adapted to be secured substantially horizontally between the bottom portion of the frame and the bottom of the door and to contact the bottom portion of the frame and the bottom of the door to form a lower weather barrier toward the back portion of the bottom of the door. The first transition seal is adapted to be secured between the first side portion of the door frame and the first side of the door and to contact the first side portion of the frame and the first side of the door to form a transition weather barrier extending between the first weather barrier and the lower weather barrier.

While multiple embodiments are disclosed, still other embodiments will become apparent to those skilled in the art from the following detailed description, which shows and describes various examples for understanding. Accordingly, the drawings and detailed description are to be regarded as illustrative in nature and not restrictive.

Figure 1:
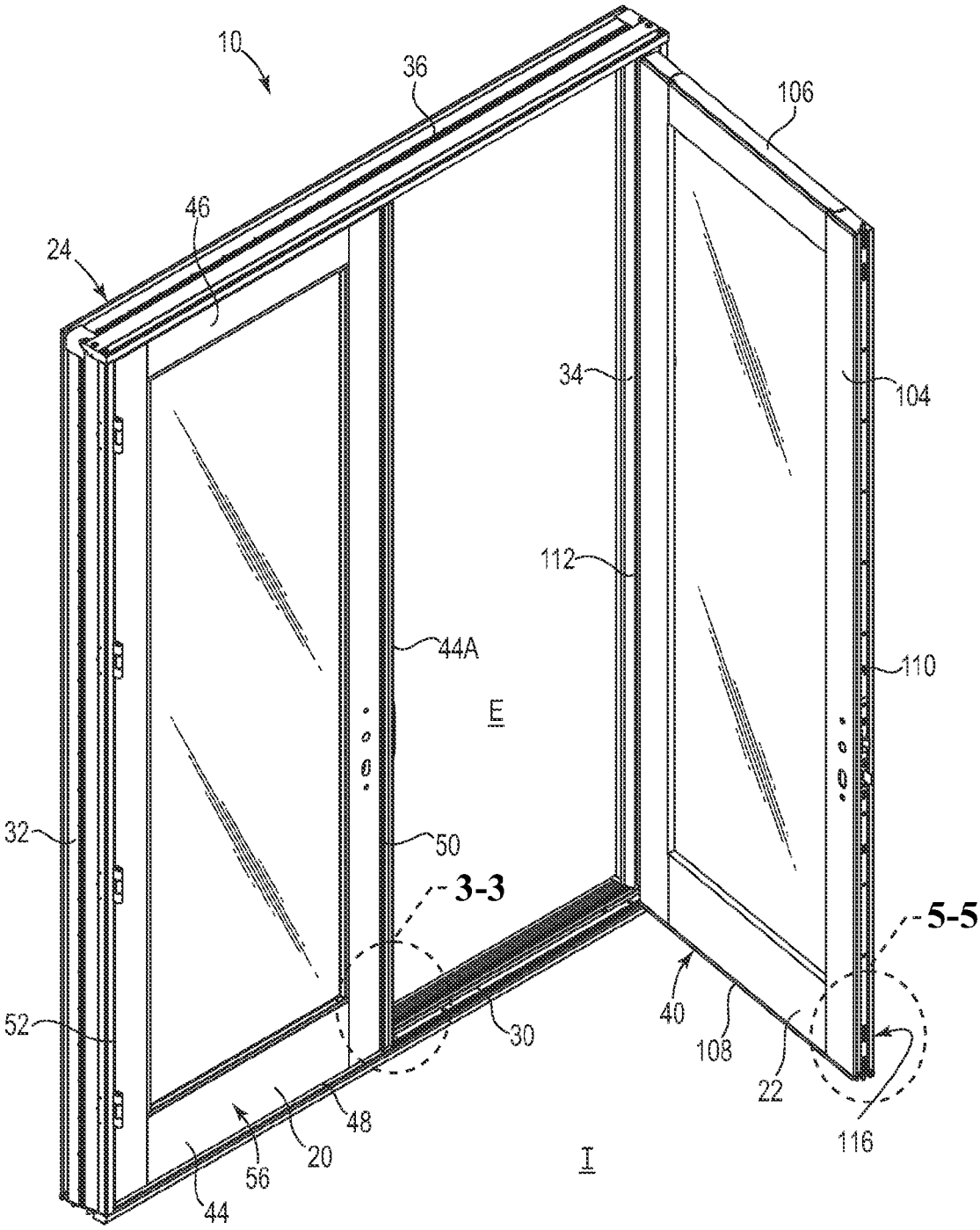
FIG. 1 is an isometric view of a door assembly from a first, interior side of the door assembly, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Various embodiments address a door assembly including a weather seal system forming a water barrier and an air barrier. The air barrier includes a sill portion, a frame portion, and a transition portion extending between the sill and frame portions. The transition portion extends inwardly and downwardly from the frame portion of the air barrier, toward an interior side of the door assembly, to the sill portion of the air barrier. At the corners of the door assembly, the transition portion provides a buffer zone, or transition zone of air at a greater spacing from the water barrier. In some embodiments, the transition zone supplies substantially dry air to any air leaks in air barrier at the lower corner(s) of the door assembly. Under some conditions, a sill area of the door assembly is particularly moist (e.g., atomized water droplets and/or other sources of moisture are often located at the exterior, lower area of the door assembly during a storm, near large bodies of water, or under other circumstances). The transition portion of the air barrier helps to move an interface between the frame and sill portions of the air barrier rearwardly, thus helping ensure dry air is made available to equilibrate the weather seal system and substantially reduce the likelihood of moisture ingress beyond the air barrier where there is a positive pressure differential between exterior and interior pressures of a structure into which the door assembly is installed. Although some exemplary features have been described above, additional or alternate features according of various embodiments are contemplated.

As used herein, the terms "seal," "weather seal," and variants thereof are not to be taken to require a perfect closure or perfect seal unless specified otherwise. In other words, in reviewing the description of the various embodiments provided below, those of skill in the art will understand the ordinary use of such terms and afford them their appropriate meaning(s).

Figure 2:
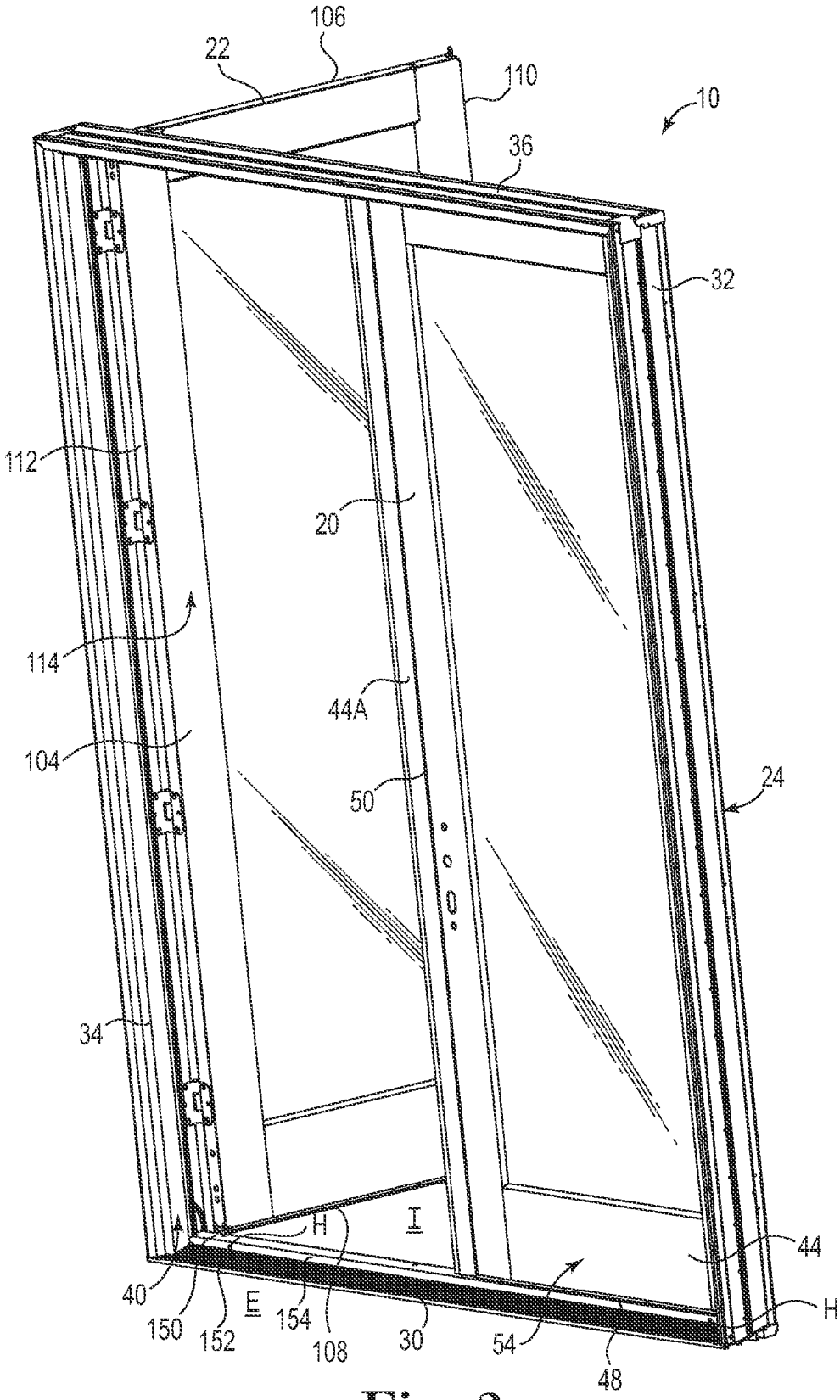
FIG. 2 is an isometric view of the door assembly of FIG. 1, from a second, exterior side of the door assembly, according to some embodiments.

FIGS. 1 and 2 are isometric views of a door assembly 10 according to some embodiments. As shown, the door assembly 10 includes a first door 20, a second door 22 and a door frame 24—the door frame 24 including a sill portion 30, a first jamb portion 32, a second jamb portion 34, and a head portion 36. The door assembly 10 also includes a weather barrier system 40 between the first and second doors 20, 22 and the door frame 24. In some embodiments, the door assembly 10 is an "in swing" door assembly (i.e., a door assembly in which the doors open to the interior in an inward direction). For example, FIG. 1 shows the door assembly 10 from an interior view (as seen from an interior I of a structure in which the door assembly 10 is installed) and FIG. 2 shows the door assembly 10 from an exterior view (as seen from an exterior E of a structure in which the door assembly 10 is installed). In some embodiments, the first door 20 is a passive door and the second door 22 is an active door. For example, the second door 22 optionally includes a handleset and locking mechanism for mating with a strikeplate mounted to the first door 20. Additional or alternate locking and security features are incorporated with the first and second doors 20, 22 as desired.

The first door 20 has a main body 44 that generally defines a top 46, a bottom 48, a first side 50, a second side 52, a front 54, and a back 56, the first door having a height between the top 46 and bottom 48 of the first door 20. The first door 20 also has a width between the front 54 and the back 56 of the first door 20. The main body 44 includes a substantially rigid stop feature 44A that extends along the corner of the front 54 and first side 50. As shown, the first door 20 is substantially rectangular and includes a glazed central area, although any of a variety of door material options (e.g., aluminum clad wood or wood fiber composite) and configurations (e.g., glazed with muntin bars or solid core) are contemplated. The back 56 of the first door 20 optionally corresponds to an interior side or interior plane of the first door 20 that, in a closed state, faces the interior I of the structure (not shown) in which the door assembly 10 is installed. In turn, the front 54 of the first door 20 optionally corresponds to an exterior side or exterior plane of the first door 20 that, in a closed state, faces the exterior E of the structure in which the door assembly 10 is installed.

Figure 3:
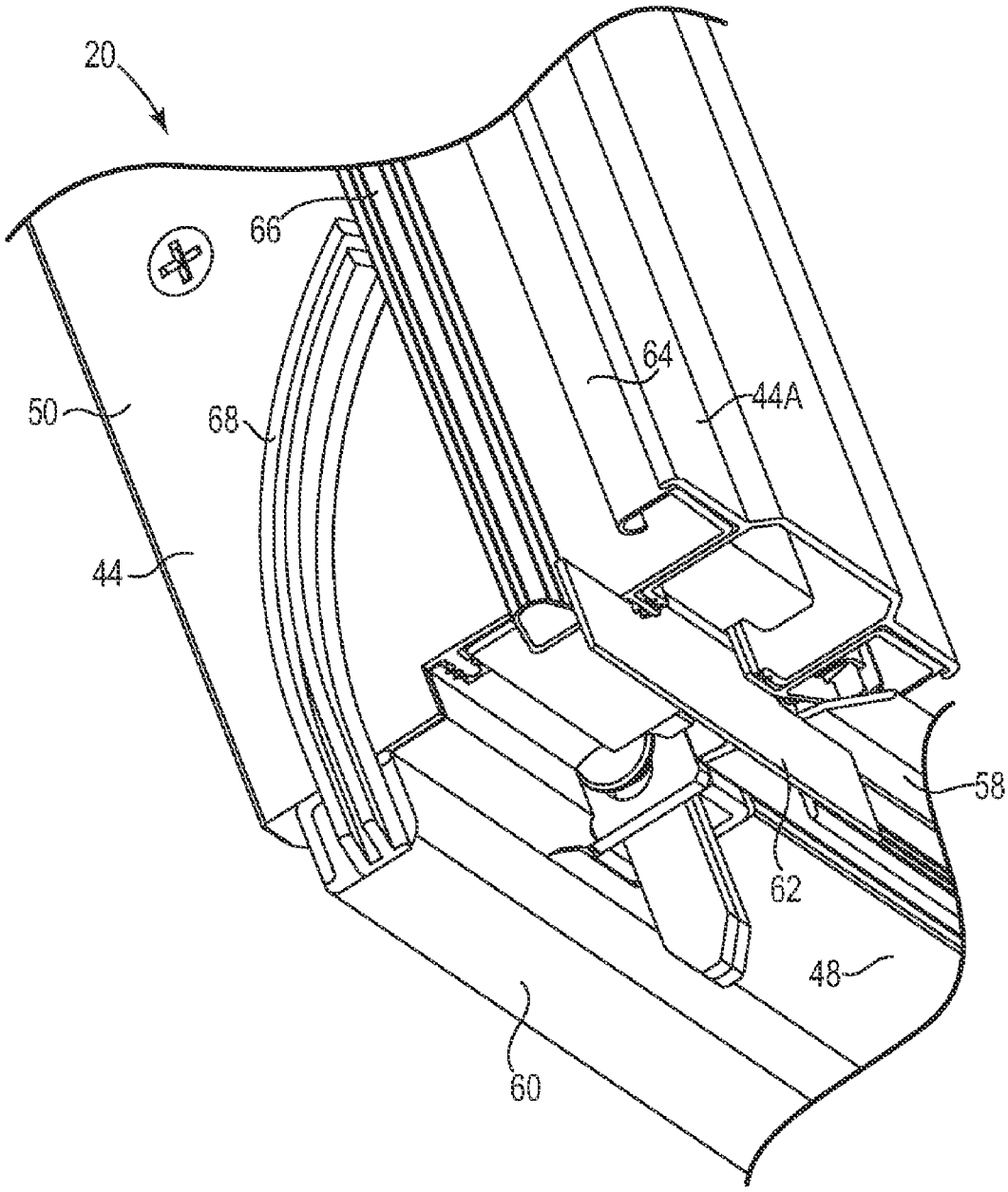
FIG. 3 is an isometric view of a portion of a first door of the door assembly of FIG. 1, that portion being designated as region 3-3 in FIG. 1, according to some embodiments.

FIG. 3 is an isometric view where the bottom 48 and first side 50 of the first door 20 meet. As shown, the first door 20 includes a first bottom seal 58, a second bottom seal 60, and a bottom connector seal 62 maintained at the bottom 48 of the first door 20 (e.g., each optionally being secured to the bottom 48 of the main body 44 via barbed retaining means, fasteners, adhesives, or otherwise). The first bottom seal 58 and the bottom connector seal 62 combine to extend along substantially all the bottom 48 of the first door 20 from the first side 50 to the second side 52 (FIG. 1). As shown, the bottom connector seal 62 also optionally projects outwardly, beyond the first side 50 to interface with one or more seal(s) maintained by the second door 22, as described in greater detail.

The first door 20 also includes a first edge seal 64, a second edge seal 66, and a transition seal 68, the transition seal 68 extending between the second edge seal 66 and the second bottom seal 60. Each of the first edge seal 64, second edge seal 66, and transition seal 68 is maintained at the first side 50 of the first door 20 (e.g., each optionally being secured to the first side 50 of the main body 44 via barbed retaining means, fasteners, adhesives or otherwise). The first edge seal 64 and the second edge seal 68 extend along substantially all the first side 50 of the first door 20 from proximate the bottom 48 to the top 46 (FIG. 1) of the main body 44. If desired, additional seals (not shown) are provided as appropriate.

Figure 4:
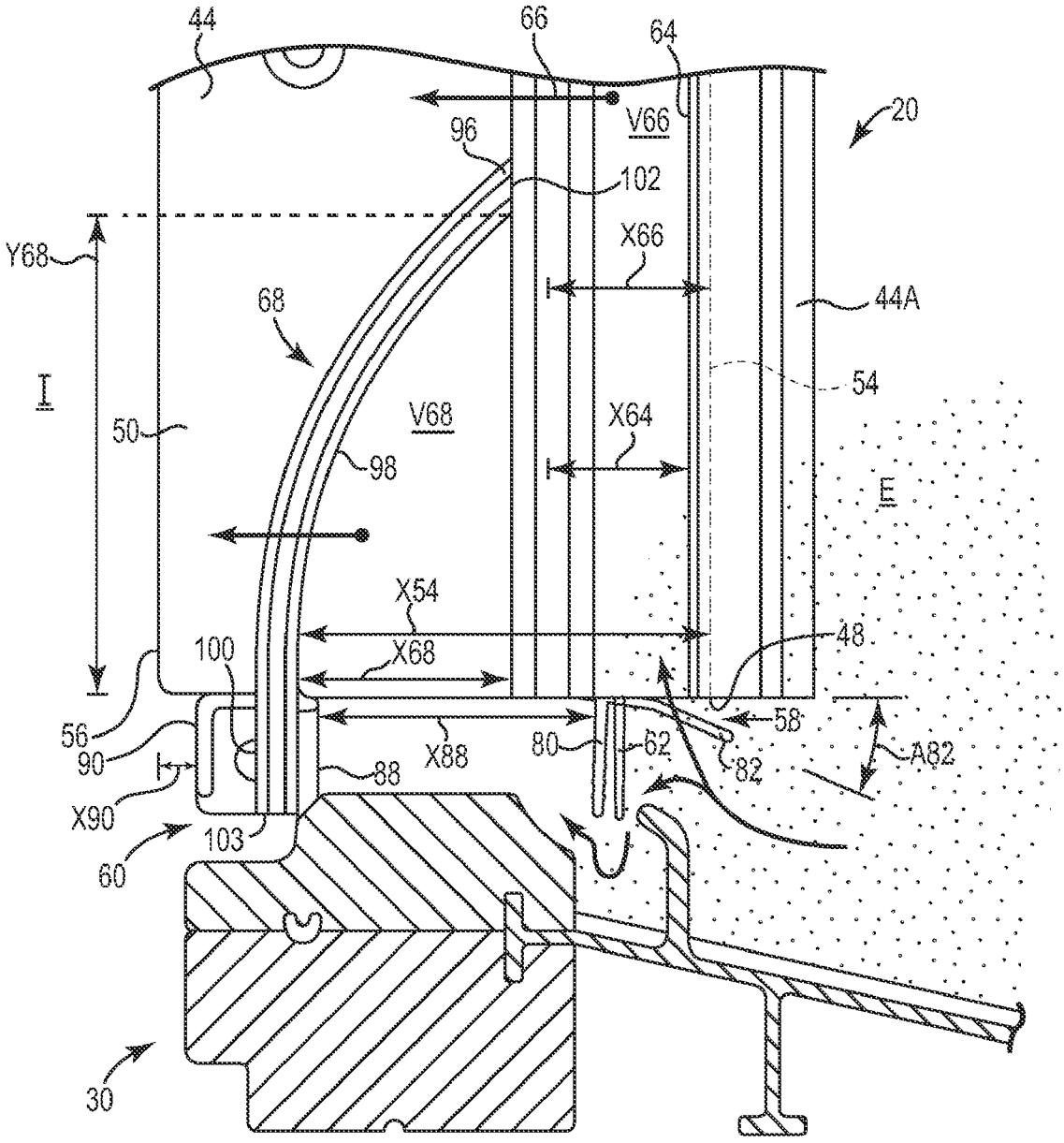
FIG. 4 is an end view of the portion of the first door of FIG. 3 and also cut off portions of a sill of the door assembly of FIG. 1, that cross-section being taken along line 4-4 as designated in FIG. 15, according to some embodiments.

FIG. 4 is an end view of the first door 20 shown in a closed state and a cross-sectional view of the sill 30. As shown, in some embodiments, the first bottom seal 58, also described as a front gasket or first barrier, for example, is formed of a substantially compliant material and extends from the first side 50 to the second side 52 (FIG. 1) of the main body 44 of the first door 20. The first bottom seal 58 is maintained by the bottom 48 of the first door 20 toward the front 54 of the first door 20 which, when the first door 20 is closed, is positioned toward the exterior E of the structure. In some embodiments, the first bottom seal 58 includes a lower flange 80, also described as a baffle, and a front flange 82, also described as a hood. The lower flange 80 projects generally downward from the bottom 48 while the front flange 82 projects forward toward and/or beyond the front 54 of the first door 20 as desired. The front flange 82 optionally projects downward a desired extent, for example at a non-zero angle A82, which is less than 45 degrees relative to the bottom 48 of the main body 44 according to some embodiments. In some embodiments, and as subsequently described, the first bottom seal 58 is adapted to serve as a portion of an outer water barrier of the door assembly 10.

The bottom connector seal 62 is optionally a substantially compliant piece of material formed into a T-shape (FIG. 3), or other shape as desired. In some embodiments, the bottom connector seal 62 provides an intermediary between the lower flange 80 and an adjacent seal of the second door 22 (not shown in FIG. 9) when the doors 20, 22 are closed. For example, the bottom connector seal 62 is adapted to overlap the lower flange 80 and extend past the first side 50 to similarly overlap a complementary seal on the second door 22.

As shown, in some embodiments, the second bottom seal 60, also described as a rear gasket or second barrier, for example, is formed of a substantially compliant material. The second bottom seal 60 is maintained by the bottom 48 of the first door 20 as desired, for example with a barbed projection extending into the bottom 48 of the first door 20. The second bottom seal 60 optionally defines a substantially square cross-section and extends from the first side 50 to the second side 52 (FIG. 1). The second bottom seal 60 is located toward the back 56 of the first door 20, which faces toward the interior I of the structure when the first door 20 is closed.

In some embodiments, the second bottom seal 60 has a leading side 88 and a trailing side 90, the trailing side 90 being the inset from the back 56 a horizontal offset X90 of about 0.15 inches, for example, or from about 0.1 inches to about 0.25 inches, for example, although a variety of dimensions are contemplated. In other embodiments, the trailing side 90 is positioned substantially flush with neighboring portions of the back 56 of the main body 44. In still other embodiments, the trailing side 90 projects from the back 56 as desired. As subsequently described, the second bottom seal 60 is adapted to serve as a portion of an inner air barrier of the door assembly 10 according to some embodiments. If desired, the lower flange 80 and the leading side 88 are spaced a horizontal distance X88 of about 0.15 inches, for example, or from about 0.1 inches to about 0.25 inches, for example, although other dimensions are contemplated.

The first edge seal 64 and the second edge seal 66 are optionally provided as a single, monolithic body as shown in FIGS. 3 and 4. In some embodiments, the first edge seal 64 is substantially J-shaped in a non-compressed, or natural state as shown in FIG. 3. The first edge seal 64, also described as a first side seal, is optionally located proximate the front 54 of the first door 20. As shown in FIG. 4, the first edge seal 64 is positioned to facilitate alignment of the first and second doors 20, 22 when they are both in a closed state. In some embodiments, the first edge seal 64 is located adjacent the substantially rigid stop feature 44A, such that upon closing the second door 22 the first edge seal 64 is engaged and compressed as desired between the stop feature 44A and the second door 22. The first edge seal 64 is adapted, or is otherwise structured such that upon the second door 22 being closed against the first edge seal 64, water ingress between the first and second doors 20, 22 is substantially reduced or prevented as subsequently described.

The second edge seal 66 is spaced rearwardly of the first edge seal 64, for example backward from the front 54 of the first door 20 a horizontal distance X66 (e.g., about 0.75 inches or from about 0.5 inches to about 1 inch, although other dimensions are contemplated). In some embodiments, the second edge seal 66, also described as a second side seal, has a substantially tear-drop shape or is substantially dome-shaped, although a variety of shapes (e.g., wiper configurations) are contemplated. The second edge seal 66 extends substantially vertically along the first side 50 at an intermediate lateral position between the front 54 and back 56 of the main body 44. In some embodiments, the second edge seal 66 is adapted to act as an air barrier between the exterior E and interior I. If desired, the first and second edge seals 64, 66 are spaced from one another an appropriate distance to encourage any water passing the first edge seal 64 to collect in the space between the first and second edge seals 64, 66 and move downward along the first side 50 toward the sill 30 portion due to gravitational forces. For example, the first and second edge seals are optionally spaced a horizontal distance X64 (e.g., about 0.7 inches or from about 0.5 inches to about 1 inch, although other dimensions are contemplated). In some embodiments, the first and second edge seals 64, 66 are also adapted to define an intermediate air zone V66 (FIG. 8) when the first and second doors 20, 22 are closed, which, as subsequently described, is optionally adapted to equilibrate to the pressure of the exterior E.

As shown in FIG. 4, the transition seal 68 includes an upper portion 96, an intermediate portion 98, and a lower portion 100 and has a top 102 and a bottom 103. The transition seal 68 is formed of a substantially flexible and/or compliant material as appropriate. In some embodiments, the upper portion 96 contacts the second edge seal 66, the intermediate portion 98 resides between the upper and lower portions 96, 100, and the lower portion 100 contacts the second bottom seal 60. In some embodiments and as shown, the transition seal 68 is of a dual wiper design, having two substantially parallel flanges adapted to engage the second door 22 as it is closed, although the transition seal 68 optionally takes on a variety of configurations (e.g., tear-drop or dome-shaped). The intermediate portion 98 is shown as being substantially arcuate and, according to some embodiments, has a radius of curvature of about 5 inches, for example, or from about 3 inches to about 7 inches, for example, although a variety of curvatures and shapes are contemplated. For example, in some other embodiments the transition seal 68 is substantially straight, extending rearwardly and downwardly at an angle (e.g., about 45 degrees) from the second edge seal 66 to the second bottom seal 60. In still other embodiments, the transition seal 68 has a stepped configuration, extending rearwardly as desired from the second edge seal 66 (e.g., substantially horizontally), and then extending downwardly at a desired angle (e.g., substantially vertically) to the second bottom seal 60. Various combinations of angled, stepped, and/or curved configurations are also contemplated.

In some embodiments, the upper portion 96 comes into contact with the second edge seal 66 at a vertical gap Y68 of about 2.5 inches, for example, or from about 1.5 inches to about 3.5 inches, for example, although a variety of dimensions are contemplated. In turn, the lower portion 100 is offset rearwardly from the second edge seal 66 at a horizontal gap X68 of about 1.2 inches, for example, or from about 0.5 inches to about 2 inches, for example, and rearwardly from the front 54 of the first door 20 a horizontal gap X54 of about 2.1 inches, for example, or from about 1.5 inches to about 3 inches, for example, although a variety of dimensions are contemplated. As will be subsequently described, the transition seal 68 helps form an inset, or inboard air zone V68 for substantially reducing or preventing water ingress into the interior I when the first and second doors are closed 20, 22.

As shown in FIGS. 1 and 2, and similarly to the first door 20, the second door 22 has a main body 104 that generally defines a top 106, a bottom 108, a first side 110, a second side 112, a front 114, and a back 116. As shown, the second door 22 is substantially rectangular and includes a glazed central area, although any of a variety of door material options and configurations are contemplated, including those previously described. As shown, the first side 110 of the second door 22 corresponds to an interior side or interior plane of the second door 22 that, in a closed state, faces the interior I of the structure (not shown). In turn, the second side 112 of the second door 22 corresponds to an exterior side or exterior plane of the second door 22 that, in a closed state, faces the exterior E of the structure in which the door assembly 10 is installed.

Figure 5:
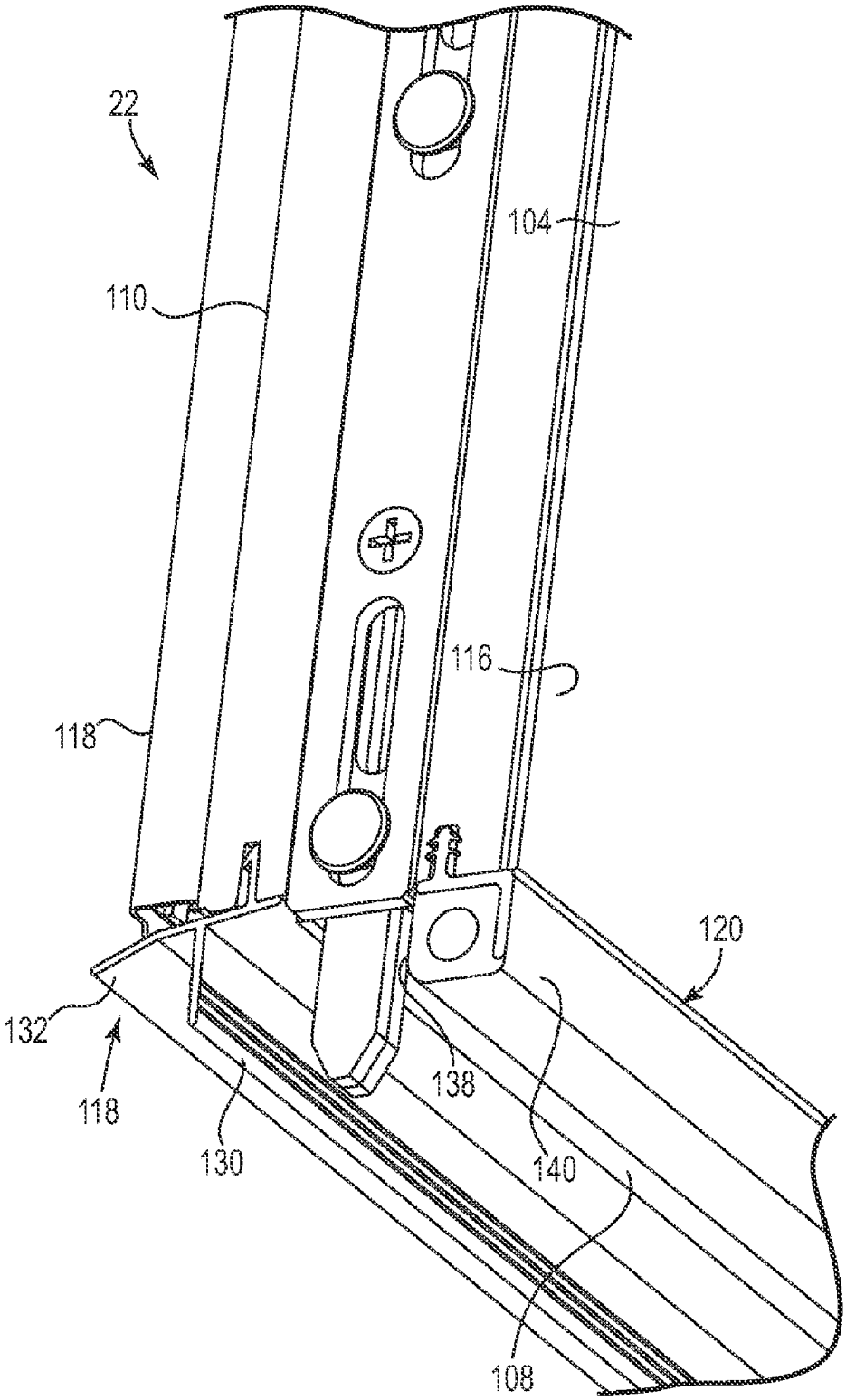
FIG. 5 is an isometric view of a portion of a second door of the door assembly of FIG. 1, that portion being designated as region 5-5 in FIG. 1, according to some embodiments.

FIG. 5 is an isometric view showing a close up where the bottom 108 and first side 110 of the second door 22 meet. As shown, the second door 22 includes a first bottom seal 118 and a second bottom seal 120 (e.g., each optionally being secured to the bottom 108 of the main body 104 via barbed retaining means, fasteners, adhesives, or otherwise), according to some embodiments.

In some embodiments, the first bottom seal 118, also described as a front gasket or first barrier, for example, is formed of a substantially compliant material and extends from the first side 110 to the second side 112 (FIG. 1) of the main body 104 of the second door 22. The first bottom seal 118 is maintained by the bottom 108 of the second door 22 toward the front 118 of the second door 22 which, when the second door 22 is closed, is offset toward the exterior E of the structure on the bottom 108 of the second door 22. The first bottom seal 118 also optionally includes a lower flange 130, also described as a baffle, and a front flange 132, also described as a hood. In some embodiments, the lower flange 130 projects generally downward from the bottom 108 while the front flange 132 projects forward toward and beyond the front 108 of the second door 22 as desired. The front flange 132 additionally or alternatively projects downward to a desired amount, for example at a non-zero angle, which is less than 45 degrees relative to the bottom 108 of the main body 104, although other angles are contemplated. In some embodiments, and as subsequently described, the first bottom seal 118 is adapted to serve as a portion of an outer water barrier of the door assembly 10.

In some embodiments, the second bottom seal 120, also described as a rear gasket or second barrier, for example, is formed of a substantially compliant material. The second bottom seal 120 is maintained by the bottom 108 of the second door 22 as desired (e.g., with a barbed projection or otherwise). The second bottom seal 120 optionally defines a substantially square cross-section and extends from the first side 110 to the second side 112 (FIG. 1). The second bottom seal 120 is located toward, or is offset toward the back 116 of the second door 22, which corresponds to the interior I of the structure when the second door 22 is closed. In some embodiments, the second bottom seal 120 has a leading side 138 and a trailing side 140, the trailing side 140 being positioned inset from the back 116 of the main body 104, being positioned generally flush with neighboring portions of the back 116 of the main body 104, or being positioned to project from the back 116 as desired. As subsequently described, the second bottom seal 120 is adapted to serve as a portion of an inner air barrier of the door assembly 10 according to some embodiments. In some embodiments, upon closing the second door 22, the bottom seals of the first and second doors 20, 22 are substantially aligned with one another, with the bottom connector seal 62 extending in front of the lower flange 130 of the second door 22.

Figure 6:
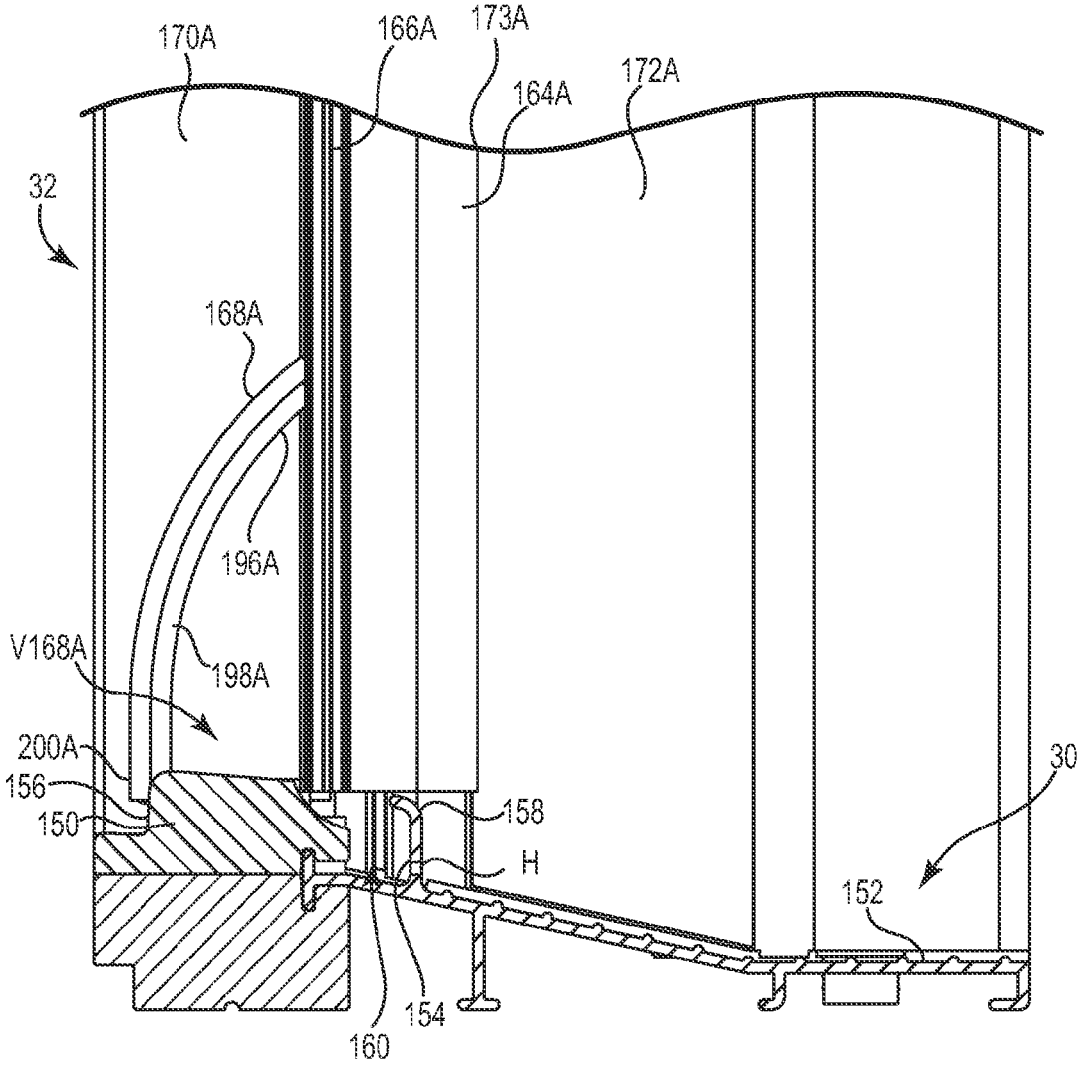
FIG. 6 is an end view of cut off portions of the sill and a first jamb portion of the door assembly of FIG.1, that cross-section being taken along line 6-6 as designated in FIG. 15, according to some embodiments.

As shown in FIG. 2, in some embodiments, the sill portion 30, also described as a bottom portion of the frame 24, includes a threshold 150, a tread 152, and a lip 154. The threshold 150 is optionally adjustable in height and defines a sill edge 156 (FIG. 6). FIG. 6 shows sectioned portions of the first jamb 32 and sill 30 where they meet, with the first door 20 removed for illustrative purposes. The tread 152 is secured to the threshold 150 as desired and includes appropriate tread features (e.g., anti-slip features). The lip 154 extends upwardly from the tread 152 and optionally includes a backwardly sloping terminal end 158. In some embodiments, the lip 154 and the threshold 150 are spaced to define a channel 160. The sill portion 30 optionally has one or more drain holes H (FIGS. 2 and 6) in the lip 154 toward the bottom of the channel 160. For example, in some embodiments, water is removed from the channel 160 using one or more of the holes H or other drain means that allow moisture that has drained into, or otherwise entered, the channel 160 to exit away from the channel 160.

In some embodiments, the first and second jamb portions 32, 34 are substantially similar, where, in general terms, the two jamb portions 32, 34 are mirror images. As such, various features of the first and second jamb portions 32, 34 are described with reference to the other, where some features of the first jamb portion 32 are labeled with a reference number followed by an "A" and features of the second jamb portion 34 are labeled with the same reference number followed by a "B."

In some embodiments, the first jamb portion 32, also described as a first side portion, includes seal features substantially similar to those of the first door 20. As shown in FIG. 6, in some embodiments, the first jamb portion 32 includes a first edge seal 164A, a second edge seal 166A, and a transition seal 168A, the transition seal 168A extending rearwardly and downwardly from the second edge seal 166A to the second bottom seal 60 (FIG. 5) of the first door 22 when the first door 20 is in a closed state. The first jamb portion 32 defines an inner side 170A and includes a jamb stop 172A (FIG. 7) that projects inwardly to overlap the front 54 of the first door 20 when the first door 20 is closed.

Each of the first edge seal 164A, the second edge seal 166A, and the transition seal 168A is maintained on an inner side 170A of the first jamb portion 32 (e.g., each optionally being secured to the inner side 170A via barbed retaining means, fasteners, adhesives or otherwise). The first edge seal 164A and the second edge seal 166A extend substantially vertically along the inner side 170A of the first jamb portion 32. If desired, additional seals (not shown) are provided as appropriate. The first edge seal 164A and the second edge seal 166A are optionally provided as a single, monolithic body as shown and/or as separate components.

In some embodiments, the first edge seal 164A is substantially J-shaped in a non-compressed, or natural state, where the first edge seal 164A is located adjacent the jamb stop 172A, such that upon closing the first door 20 the first edge seal 164A is engaged and compressed as desired between the jamb stop 172A and the first door 20. The first edge seal 164A is adapted, or is otherwise structured such that upon the first door 20 being closed against the first edge seal 164A, water ingress between the first doors 20 and first jamb portion 32 is substantially reduced or prevented.

The second edge seal 166A is spaced rearwardly of the first edge seal 164A, for example backward from a rear edge 173A of the jamb stop 172A a distance of about 0.75 inches (e.g., being similar to distance X66), although other dimensions are contemplated. In some embodiments, the second edge seal 166A has a substantially tear-drop shape or is substantially dome-shaped, although a variety of configurations are contemplated. The second edge seal 166A extends substantially vertically along the inner side 170A at an intermediate lateral position between the first edge seal 164A and the transition seal 168A. In some embodiments, the second edge seal 166A is adapted to act as an air barrier between the exterior E and interior I when the first door 20 is closed. Similarly to some embodiments of the edge seals previously described, the first and second edge seals 164A, 166A are optionally spaced from one another an appropriate distance or otherwise configured to encourage water passing the first edge seal 164A to collect in the space between the first and second edge seals 164A, 166A and move downward along the inner side 170A toward the sill 30 portion due to gravitational forces. In some embodiments, the first and second edge seals 164A, 166A are also adapted to define an intermediate air zone V164A (FIG. 8) when the first door 20 is closed, which, as subsequently described, is optionally adapted to equilibrate to the pressure of the exterior E.

As shown in FIG. 6, the transition seal 168A is optionally configured similarly to the transition seal 68 (FIG. 3), the transition seal 168A including an upper portion 196A, an intermediate portion 198A, and a lower portion 200A and has a top and a bottom. The upper portion 196A is in communication with the second edge seal 166A, the intermediate portion 198A resides between the upper and lower portions 196A, 200A, and the lower portion 200A extends down to the sill edge 156 of the threshold 150. In some embodiments and as shown, the transition seal 168A is of a dual wiper design, having two parallel flanges adapted to engage the first door 20, although the transition seal 168A optionally takes on a variety of configurations. The intermediate portion 198A is shown as being substantially arcuate and, according to some embodiments, having a radius of curvature similar to those previously described. As alluded to above, however, in other embodiments the transition seal 168A is substantially straight, extending rearwardly and downwardly at an angle from the second edge seal 166A to the sill edge 156 and, in still other embodiments, the transition seal 168A has a stepped configuration, extending rearwardly as desired from the second edge seal 166A (e.g., substantially horizontally), and then extending downwardly at a desired angle (e.g., substantially vertically) to the sill edge 156. Various combinations of angled, stepped, and curved configurations are also contemplated.

In some embodiments, the upper portion 196A comes into contact with the second edge seal 166A at a vertical gap of about 2.5 inches, for example, or from about 1.5 inches to about 3.5 inches, for example, although a variety of dimensions are contemplated. The lower portion 200A is offset rearwardly from the second edge seal 166A at a horizontal gap of about 1.2 inches, for example, or from about 0.5 inches to about 2 inches, for example, and rearwardly from the jamb stop 172A a horizontal gap of about 2 inches, for example, or from about 1.5 inches to about 3 inches, for example, although a variety of dimensions are contemplated. As will be subsequently described, the transition seal 168A forms an inset air source, or inboard air zone V168A for substantially reducing or preventing water ingress between the first door 20 and the first jamb portion 32 into the interior I when the first door is closed 20 as subsequently described.

Figure 7:
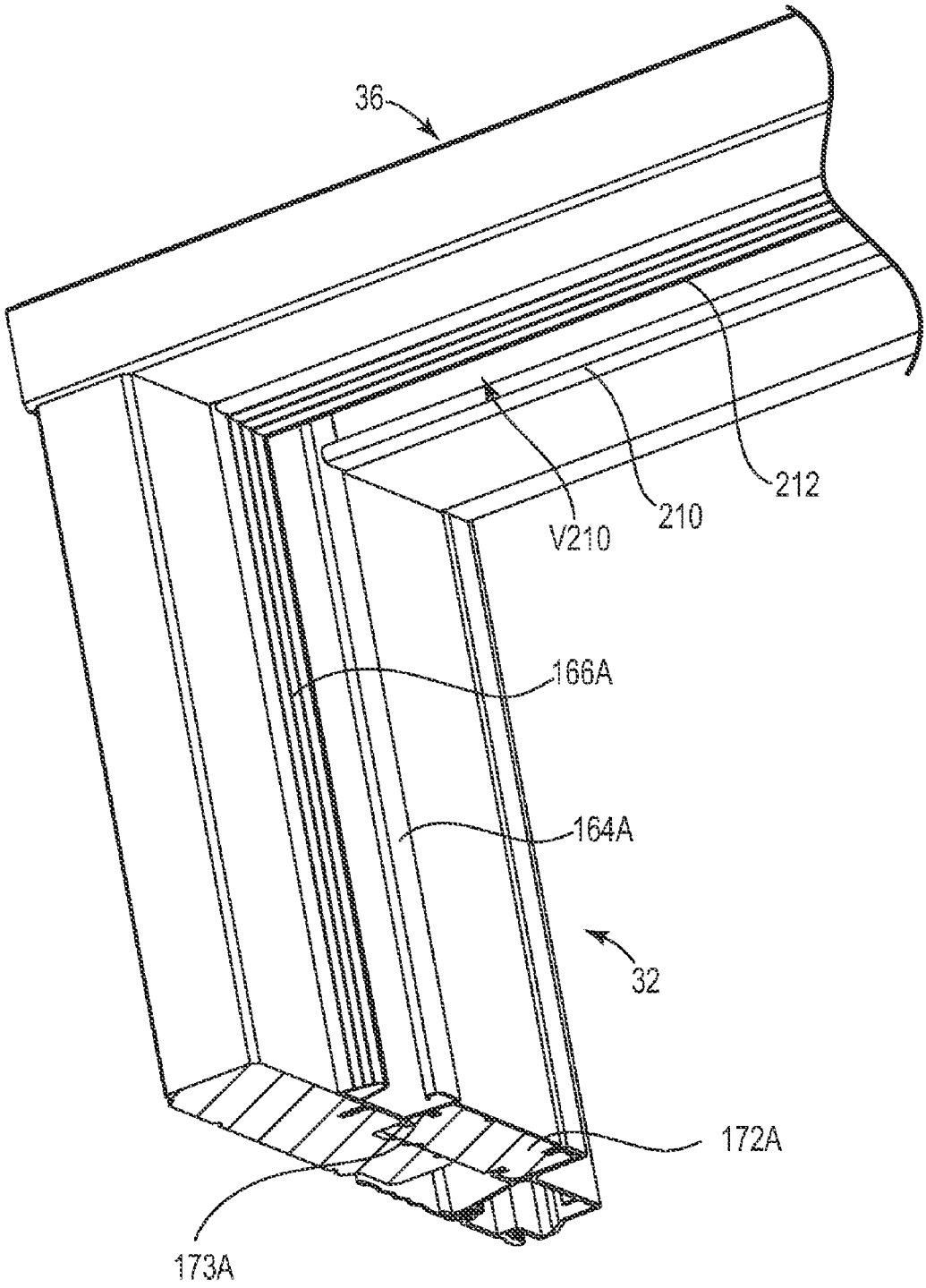
FIG. 7 is an isometric view of cut off portions of the first jamb portion and a head of the door assembly of FIG. 1, that cross-section being taken along line 7-7 as designated in FIG. 15, according to some embodiments.

FIG. 7 shows the head portion 36 at a corner where the head portion 36 meets the first jamb portion 32. According to some embodiments, the head portion 36, also described as a top portion, includes a first edge seal 210 and a second edge seal 212 that both extend horizontally across the head portion 36. The first edge seal 210 of the head portion 36 is substantially similar to and is substantially aligned with the first edge seals 164A, 164B, respectively, of the first and second jamb portions 32, 34. The second edge seal 212 of the head portion 36 is substantially similar to and is substantially aligned with the second edge seals 166A, 166B, respectively, of the first and second jamb portions 32, 34. In some embodiments, the first and second edge seals 210, 212 are also adapted to define an intermediate air zone V210 when the first and second doors 20, 22 are closed, which, as subsequently described, is optionally adapted to equilibrate to the pressure of the exterior E. Various additional or alternate features for the head portion 36 are contemplated.

Some methods for making the door assembly 10 and providing the weather barrier system 40 between the first and second doors 20, 22 and the door frame 24 include securing the doors 20, 22 to the frame 24 and securing the various seals such that, when the first and second doors 20, 22 are in a closed state, the seals reside between the doors 20, 22 and the frame 24. Although embodiments having two doors are described, it should also be understood that single door embodiments are also contemplated. For example, in some embodiments, the first door 20 is not present and the frame 24 is sized to receive the second door 22, the second door 22 being hinged to the first jamb portion 32, for example, and the second jamb portion 34 carrying a strike plate or the like. Although some examples have been provided with various seals being secured to either the doors 20, 22 or the frame 24, it should be understood that the seals are secured to the doors 20, 22 or the frame 24 as appropriate.

In some embodiments, forming the weather barrier system 40 includes maintaining the first and second edge seals 64, 66 and the transition seal 68 with the first side 50 of the first door 20 such that they reside between the first and second doors 20, 22 when the doors 20, 22 are in a closed state. In other embodiments, the first and second edge seals 64, 66 and the transition seal 68 are secured to the second door 22 such that each of the seals 64, 66, 68 are provided between the first and second doors 20, 22 when they are closed.

The first bottom seal 58, second bottom seal 60, and bottom connector seal 62 are also secured to the first door 20 such that each are provided between the sill 30 and the first door 20 when the first door 20 is closed. In other embodiments, one or more of the first bottom seal 58, second bottom seal 60, and the bottom connector seal 62 are secured to the sill 30. In turn, the first bottom seal 118 and the second bottom seal 120 are secured to the second door 22 such that each reside between the sill 30 and the second door 22 when the second door 22 is closed. In other embodiments, one or more of the first and second bottom seals 118, 120 are secured to the sill 30.

In some embodiments, the first and second edge seals 164A, 166A and the transition seal 168A are maintained by the first jamb portion 32 and the first and second edge seals 164B, 166B and the transition seal 168B are maintained by the second jamb portion 34, such that, when the doors 20, 22 are closed, the first and second edge seals 164A, 166A, and the transition seal 168A reside between the first door 20 and the first jamb portion 32 and the first and second edge seals 164B, 166B and the transition seal 168B reside between the second door 22 and the second jamb portion 34. In other embodiments, one or more of the first and second edge seals 164A, 164B, 166A, 166B and the transition seals 168A, 168B are maintained by the first and/or second doors 20, 22, respectively.

The first and second edge seals 210, 212 are secured between the tops 46, 106 of the first and second doors 20, 22 and the head potion 36 when the first and second doors 20, 22 are closed. For example, the first and second edge seals 210, 212 are optionally secured to the head portion 36 (e.g., using barbs, fasteners, adhesives, or other fastening means) such that the first and second edge seals 210, 212 reside between the frame 24 and the first and second doors 20, 22. In other embodiments, the first and second edge seals 210, 212 are secured to the tops 46, 106 of the first and second doors 20, 22 such that the first and second edge seals 210, 212 reside between the first and second doors 20, 22 and the head portion 36.

Figure 8:
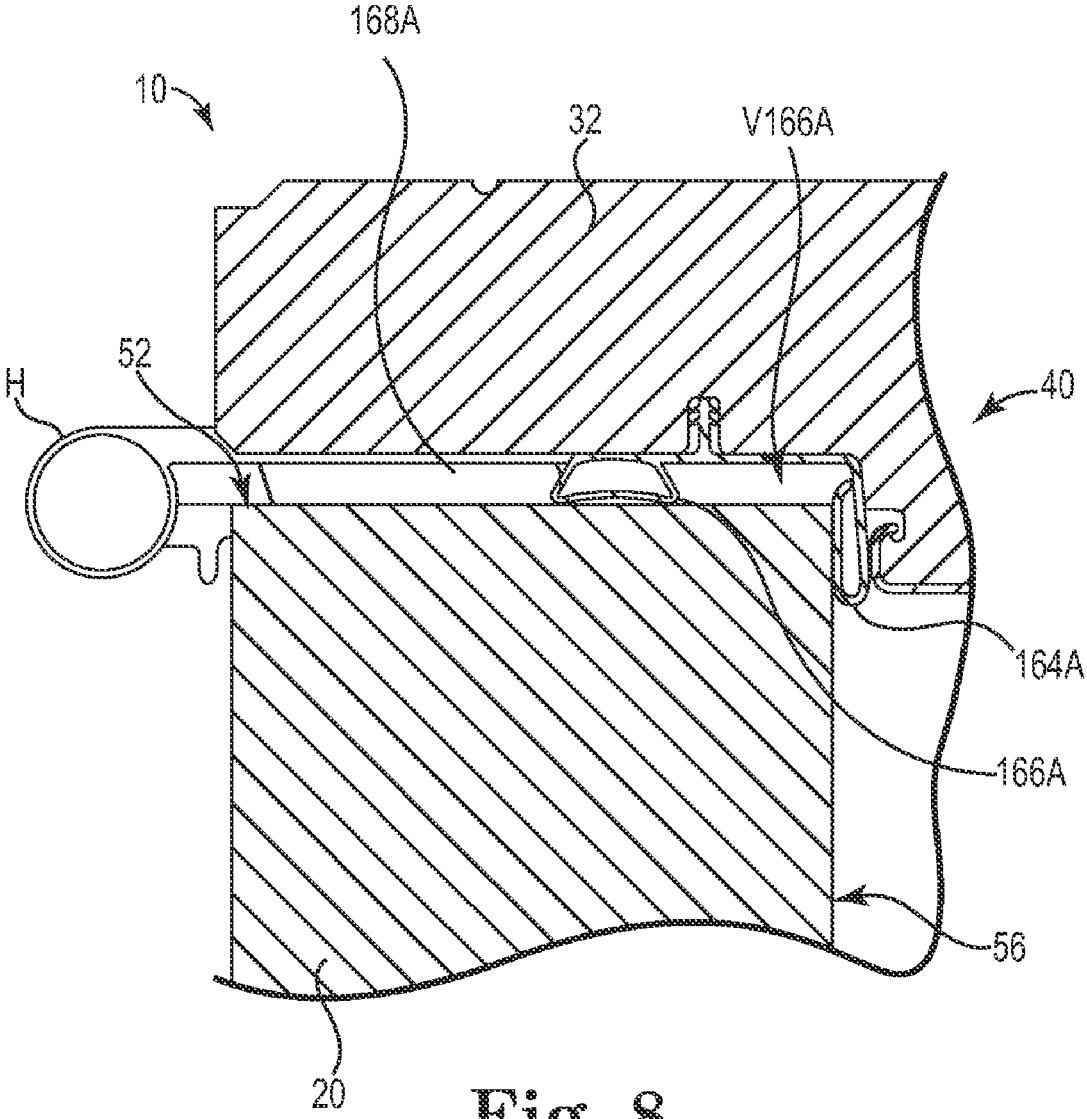
FIG. 8 is a cross-section of a plan view of the first jamb portion and the first door of the door assembly of FIG. 1, that cross-section being taken along line 8-8 as designated in FIG. 15, according to some embodiments.

In some embodiments, upon closing the first and second doors 20, 22, the first and second edge seals 64, 66 and the transition seal 68 are engaged (e.g., compressed a desired extent) between the first and second doors 20, 22. In turn, the first and second edge seals 164A, 166A and the transition seal 168A are engaged (e.g., compressed a desired extent) between the first door 20 and the first jamb portion 32; the first and second edge seals 164B, 166B and the transition seal 168B are engaged (e.g., compressed a desired extent) between the second door 22 and the second jamb portion 34; and the first and second edge seals 210, 212 are engaged (e.g., compressed a desired extent) between the head portion 36 and the first and second doors 20, 22. FIG. 8 is a sectional view of such engagement, where the first door 20 and the first jamb portion 32 are shown with the first door 20 in a closed state. As shown, the first and second edge seals 164A, 166A are engaged by the first door 20, with the front 56 of the first door 20 engaging the first edge seal 164A and the second side 52 of the first door 20 engaging the second edge seal 166A. The first door 20, the first edge seal 164A, and the second edge seal 166A bound an intermediate air zone V166A between the first and second edge seals 164A, 166A. In some embodiments, and as partially shown in FIG. 4, for example, as part of forming the weather barrier system 40 the first bottom seals 58, 118 are brought into proximity with the sill 30 and/or engage the sill 30 as desired. In turn, the second bottom seals 60, 120 engage the threshold 150 as desired. As described in greater detail, upon closing the doors 20, 22 various weather barriers comprising the weather barrier system 40 are formed.

Figure 9:
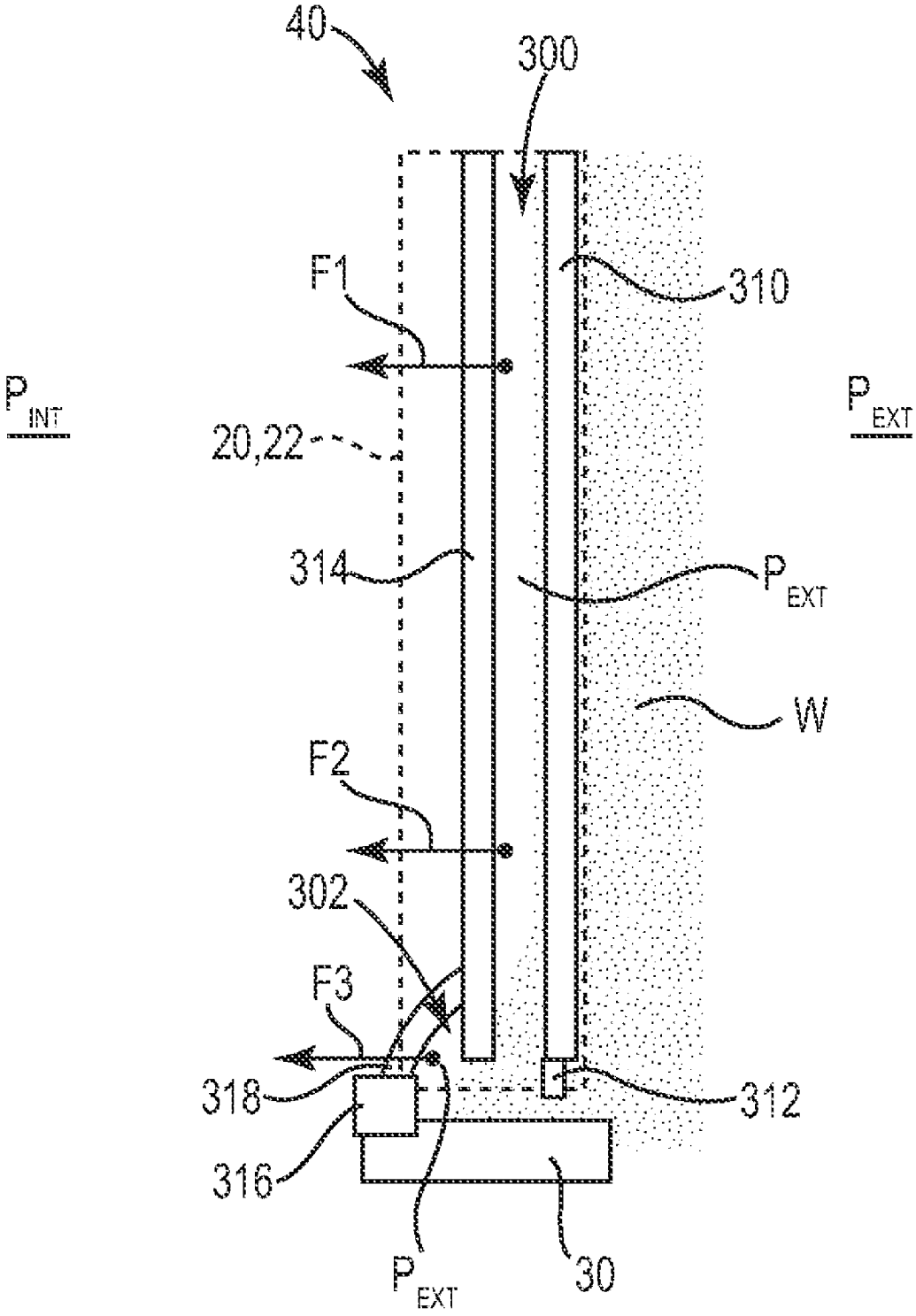
FIG. 9 is a schematic view of a weather seal system of the door assembly of FIG. 1, according to some embodiments.

FIG. 9 is provided as a schematic view of the weather barrier system 40 that is useful for describing structure and operation of the weather barrier system 40 according to some embodiments. As illustrated, the weather barrier system 40 has an intermediate air space 300, an inboard air space 302, an edge water barrier 310, a bottom water barrier 312, an edge air barrier 314, a bottom air barrier 316, and a transition air barrier 314 according to some embodiments.

In some embodiments, the intermediate air space 300 includes the intermediate air zones V66, V166A, V166B between each of the first and second edge seals 64 and 66, 164A and 166A, 164B and 166B when the first and second doors 20, 22 are closed. As described in greater detail below with reference to FIG. 9, the intermediate air space 300 is optionally defined between the edge water barrier 310 and the edge air barrier 316 according to some embodiments.

In some embodiments, the inboard air space 302 includes the inboard air zones V68, V168A, V168B in front of the transition seals 68, 168A, 168B when the first and second doors 20, 22 are closed. As described in greater detail below, the inboard air space 302 is optionally defined by the transition air barrier 318 and the bottom air barrier 316. In some embodiments, the intermediate air space 300 and the inboard air space 302 are connected air spaces being at substantially the same pressure.

In some embodiments, the edge water barrier 310, also described as a first edge weather barrier, is formed by each of the first edge seals 62, 164A, 164B, where the first edge seal 62 forms a portion of the edge water barrier 310 between the first and second doors 20, 22; the first edge seal 164A forms a portion of the edge water barrier 310 between the first door 20 and the first jamb portion 32; and the first edge seal 164B forms a portion of the edge water barrier 310 between the second door 22 and the second jamb portion 34. In some embodiments, the first edge seal 210 of the head 36 also forms part of the edge water barrier 310.

The bottom water barrier 312, also described as a first bottom weather barrier, is optionally formed by each of the first bottom seals 58, 118 and the bottom connector seal 62. FIG. 4 shows the first bottom seal 58 and bottom connector seal 62, where in some embodiments the first bottom seals 58, 118 are generally similarly positioned with respect to the sill 30. As shown in FIG. 4, the first bottom seal 58 and the bottom connector seal 62 are positioned to substantially inhibit water ingress between the sill 30 and the first and second doors 20, 22 while helping allow sufficient air to pass to equilibrate the intermediate air space 300 to the external pressure Pext (FIG. 9). In particular, and in some embodiments, the first bottom seals 58, 118 and the bottom connector seal 62 are adapted to direct water (e.g., droplets and/or condensate) downward into the channel 160 or toward the exterior over the terminal end 158 of the lip 154 and onto the tread 152, for example.

As shown in FIG. 4, for example, a gap is formed between the terminal end 158 and the lower flange 80 of the first bottom seal 58 and between the terminal end 158 and the bottom connector seal 62. The front flange 82 is also spaced from the terminal end 158 as desired. Thus, in some embodiments, the gap between the sill 30 and the first bottom seal 58 and between the sill 30 and the bottom connector seal 62 helps air at the external pressure Pext to pass into the inboard air zone V68 in front of the transition seal 68 and the second bottom seal 60 and the intermediate air zone V66 between the first and second edge seals 64, 66. Similarly, the gap between the sill 30 and the second bottom seals 58, 118 helps air at the external pressure Pext pass into the inboard air zones V168A, V168B and the intermediate zones V166A, V166B.

The edge air barrier 314, also described as a second edge weather barrier, is optionally formed by the second edge seals 64, 164A, 164B when the first and second doors 20, 22 are closed. In some embodiments, the edge air barrier 314 is adapted to substantially reduce or block air passage into the interior I. In particular, and in some embodiments, the second edge seal 66 is engaged between the first and second doors 20, 22 to form a portion of the edge air barrier 314; the second edge seal 166A is engaged between the first door 20 and the first jamb portion 32 to form a portion of the edge air barrier 314; and the second edge seal 166B is engaged between the second door 22 and the second jamb portion 34 to form a portion of the edge air barrier 314. In some embodiments, the second edge seal 212 is engaged between the head portion 36 and the first and second doors 20, 22 to form a portion of the edge air barrier 314 as well. As will be described in greater detail, the edge air barrier 314 does not necessarily form a perfect air seal between the interior I and exterior E.

In some embodiments, the bottom air barrier 316, also described as a second bottom barrier, is formed by the second bottom seals 60, 120 when the first and second doors 20, 22 are in the closed state. In some embodiments, the second bottom seal 60 is engaged between the first door 20 and the sill 30, and in particular the threshold 150 and the second bottom seal 120 is engaged between the second door 22 and the threshold 150 to form the bottom air barrier 316. In some embodiments, the edge air barrier 314 is adapted to substantially reduce or prevent air passage into the interior I. As will be described in greater detail, the edge air barrier 314 does not necessarily form a perfect air seal between the interior I and exterior E.

In some embodiments, the transition air barrier 318, also described as a transition weather barrier, is formed by the transition seals 68, 168A, 168B when the first and second doors 20, 22 are closed. In some embodiments, the transition seal 68 is engaged between the first and second doors 20, 22 to form a part of the transition weather barrier 318; the transition seal 168A is engaged between the first door 20 and the first jamb portion 32 to form a part of the transition weather barrier 318; and the transition seal 168B is engaged between the second door 22 and the second jamb portion 34 to form a part of the transition weather barrier 318.

As previously referenced the pressure in the intermediate air space 300 approaches or is substantially equal to the external pressure Pext. By decreasing the pressure drop across the edge water barrier 310, as well as the bottom water barrier 312, the likelihood of water ingress across the edge water barrier 310 and the bottom water barrier 312 is substantially reduced (e.g., where heightened external pressure Pext due, for example, to high winds is often present during a rain storm).

Although the edge water barrier 310 is adapted to substantially prevent water ingress, the edge water barrier 310 and bottom water barrier 312 are in direct contact with water (e.g., during a rain storm) and some smaller quantities of water W may pass the edge water barrier 310 under certain conditions. As generally illustrated in FIG. 9, with respect to the upper and intermediate portions of the door assembly 10, small amounts of water W may enter into the intermediate air space 300, but will generally run down the first and second sides 50, 52, 110, 112 of the first and second doors 20, 22 to the sill 30 (e.g., due to gravitational forces and sufficient wicking action) without contacting or otherwise wetting out the edge air barrier 314. Moreover, in some embodiments, by substantially equilibrating the pressure in the intermediate air zones V66, V166A, V166B to the external pressure Pext, the water is able to move downwardly toward the sill 30 without being opposed by a higher, external pressure at the sill 30.

Toward the bottom of the door assembly 10, and in particular at the lower corners of the door assembly toward the bottoms 48, 108 of the first and second doors 20, 22, significantly more demanding conditions are often present. For example, water droplets striking the sill 30 during a rain storm atomize and are more prone to passing the edge and bottom water barriers 310, 312 under the first and second doors 20, 22. Water W running down the first and second sides 50, 52, 110, 112 of the first and second doors 20, 22 to the sill 30 accumulates toward the lower corners of the first and second doors 20, 22. Additionally, the gap between the first bottom seals 58, 118 and the sill 30 (which optionally provides a pathway for air to equilibrate the intermediate air space 300 and the inboard air space 302 to the external pressure Pext) provides a limited pathway for increased entry of water W. The heightened water conditions toward the bottom corners of the doors 20, 22 is shown schematically in FIG. 9 by the increased size of the dotted area. Thus, under some conditions, there is an increased potential that the edge air barrier 314 will become wet or otherwise contact water W. Such wet contact can be problematic, for example where there are air leaks such as the upper air leak F1, the intermediate air leak F2, and the lower air leak F3 into the interior I. In particular, the air leaks F1, F2, F3 are more likely to draw water W with them across the edge air barrier 314 if the edge air barrier 314 is wet.

The inboard air space 302 provides an additional "dry air" volume to feed lower leaks (e.g., lower air leak F3), which would otherwise be in contact with water W under high moisture conditions. In particular, the transition seals 68, 168A, 168B help transition the edge air barrier 314 back to the bottom air barrier 316 toward the bottom corners of the doors 20, 22, without providing a significant pathway for moisture ingress. Thus, the transition air barrier 318 facilitates a system in which the air and water seals are situated relatively close to one another around much of the door perimeters while accounting for increased performance needs proximate the lower portions of the doors 20, 22 toward the sill 30. In some embodiments, the relatively smaller spacing between the edge air and edge water barriers 310, 314 provides space for mounting components such as hinges H (FIG. 8), bolts, latches, lock plates, strike plates, and other additional or alternate components, for example.

Figure 10A:
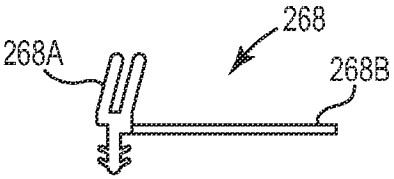
FIGS. 10A-14B illustrate various embodiment transition seals of the door assembly of FIG. 1, according to some embodiments.
Figure 10B:
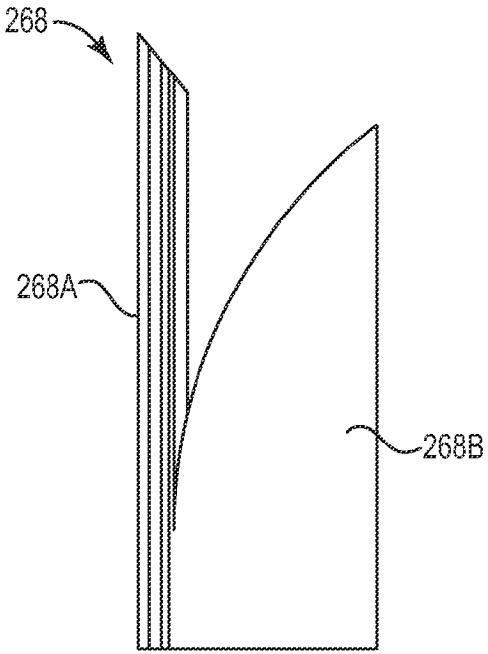
Figure 10C:
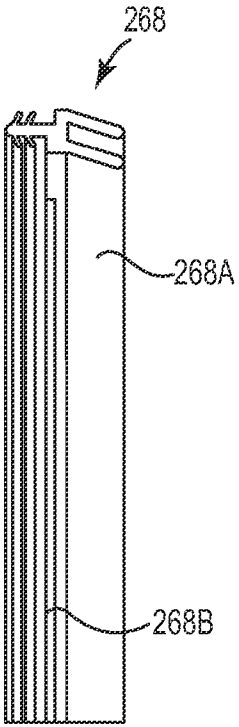
Figure 10D:
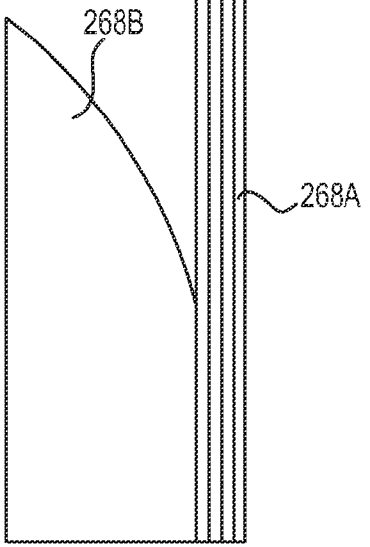

FIGS. 10A-10D illustrate another transition seal 268 usable with the door assembly 10 according to some embodiments, where FIG. 10A is a top view, FIG. 10B is a left end view, FIG. 10C is a front view, and FIG. 10D is a right end view of the transition seal 268. As shown, the transition seal 268 includes a wiper portion 268A and a flange portion 268B, each optionally formed as integral parts. The wiper portion 268A and the flange portion 268B are shown in an unfolded, or unformed state prior to folding the wiper portion 268A downwardly into an arcuate shape. In some embodiments, the flange portion 268B helps cover and/or protect the first and/or second jamb portions 32, 34 adjacent the wiper portion 268A of the transition seal 268.

Figure 11A:
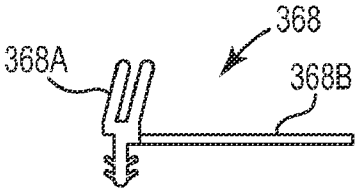
Figure 11B:
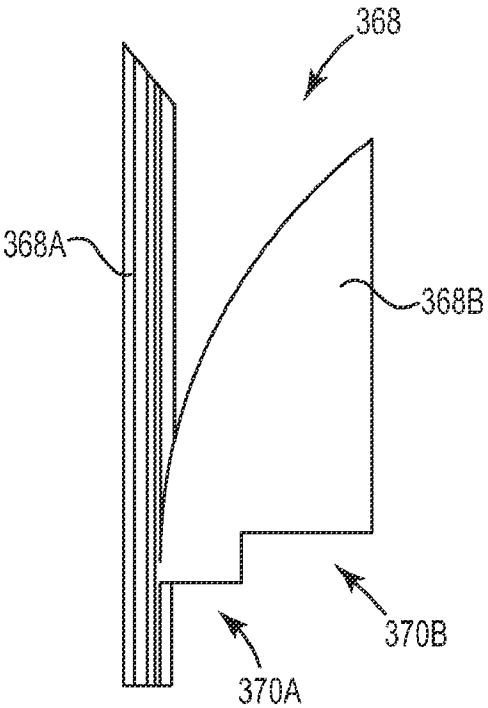
Figure 11C:
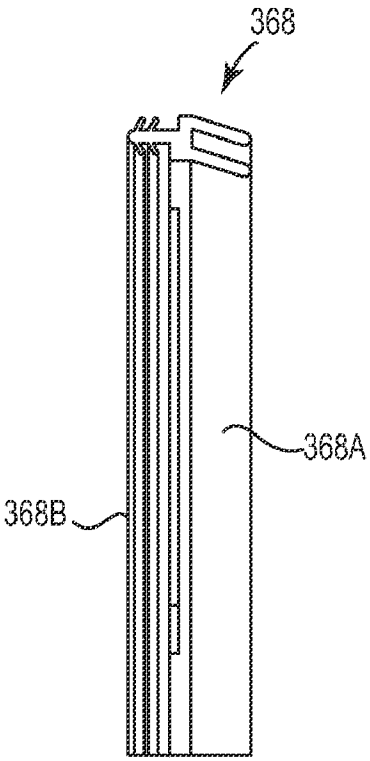
Figure 11D:
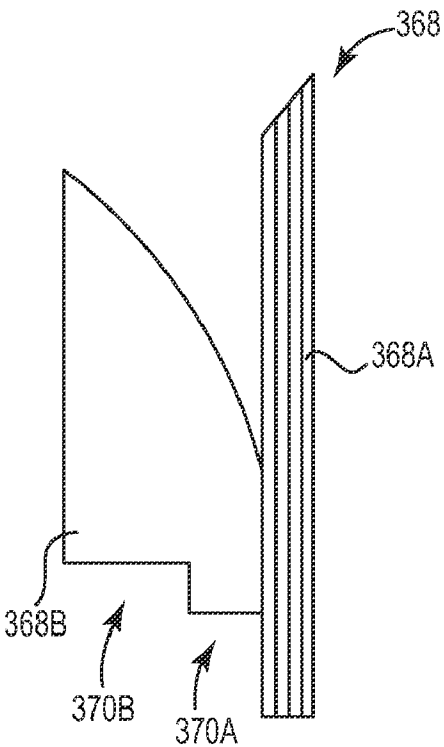
Figure 13A:
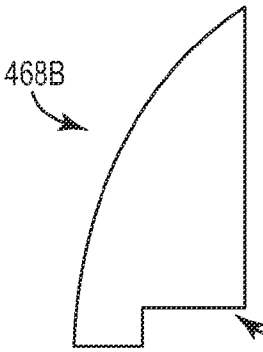
Figure 13B:
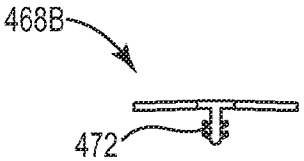
Figure 14A:
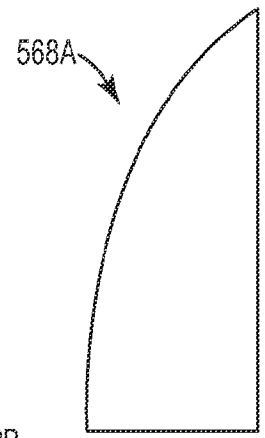
Figure 14B:
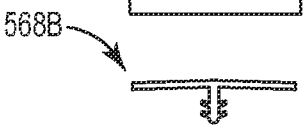

FIGS. 11A-11D illustrate another transition seal 368 usable with the door assembly 10 according to some embodiments, where FIG. 11A is a top view, FIG. 11B is a left end view, FIG. 11C is a front view, and FIG. 11D is a right end view of the transition seal 368. As shown, the transition seal 368 also includes a wiper portion 368A and a flange portion 368B, each optionally formed as integral parts. The wiper portion 368A and the flange portion 368B are shown in an unfolded, or unformed state prior to folding the wiper portion 368A downwardly into an arcuate shape. The flange portion 368B is shown connected upwardly, at an offset from the bottom of the wiper portion 368A, where such that the transition seal 368 defines two cut out areas 370A, 370B under the flange portion 368B. In some embodiments, the flange portion 368B helps cover and/or protect the first door 20 adjacent the wiper portion 368A of the transition seal 368, where the cut out areas 370A, 370B help accommodate features of the door assembly 10, such as the sill 30 of the door assembly 10 when the first door 20 is in the closed state.

Figure 12A:
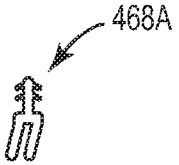
Figure 12B:
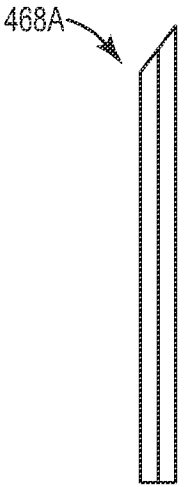
Figure 12C:
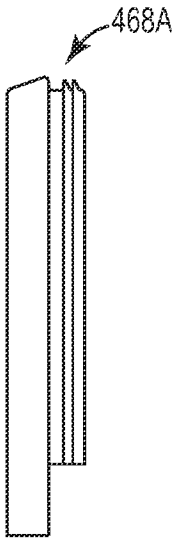
Figure 15:
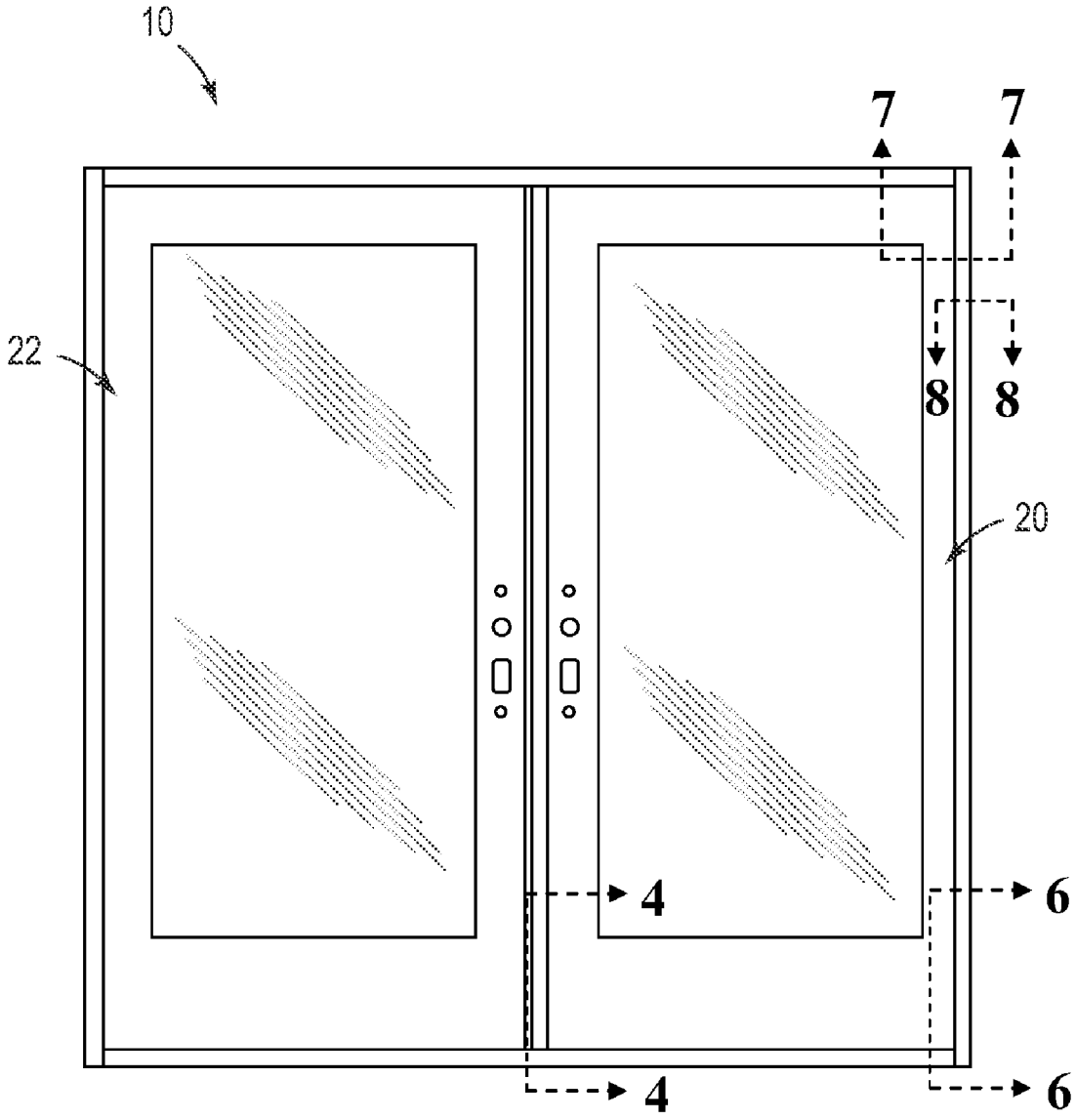
FIG. 15 is an exterior view of the door assembly of FIG. 1, according to some embodiments.

FIGS. 12A-14B illustrate still another transition seal 468 according to some embodiments. In particular, the transition seal 468 is formed of two distinct components, where the wiper portion 468A (FIGS. 12A-12C) is separate from the flange portion 468B (FIGS. 13A, 13B). FIG. 12A is a top view, FIG. 12B is an end view, and FIG. 12C is a front view of the wiper portion 468A and FIG. 13A is an end view and FIG. 13B is a bottom view of the flange portion 468B. As shown, the transition seal 468 is optionally configured similarly to the transition seal 368 to be mounted to the first door 20, where the flange portion 468B includes a cut out 470B and also includes fixation means 472, such as a barbed projection for inserting into the first door 20. The transition seal 468 is optionally adapted for mounting to the first and second jamb portions 32, 34, for example including a flange portion 568B as shown in FIGS. 14A (an end view thereof) and 14B (a bottom view thereof).

Although various embodiments address a weather seal system for a door assembly, similar embodiments to those described address use of substantially similar systems with other fenestration products, such as windows. Moreover, various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A door assembly comprising:

a frame including a top portion, a bottom portion, a first side portion, and a second side portion opposite the first side portion;

a door secured to the frame and having a top, a bottom, a first side, a second side opposite the first side, a front, and a back, the first side having a front portion toward the front of the door and a back portion toward the back of the door and the bottom having a front portion toward the front of the door and a back portion toward the back of the door;

a first side seal adapted to be secured substantially vertically between the first side portion of the door frame and the first side of the door and to contact the first side portion of the door frame and the first side of the door to form a first weather barrier toward the front portion of the first side of the door;

a lower seal adapted to be secured substantially horizontally between the bottom portion of the frame and the bottom of the door and to contact the bottom portion of the frame and the bottom of the door to form a lower weather barrier toward the back portion of the bottom of the door; and a first transition seal adapted to be secured between the first side portion of the door frame and the first side of the door and to contact the first side portion of the frame and the first side of the door to form a transition weather barrier extending between the first weather barrier toward the front portion of the first side of the door and the lower weather barrier toward the back portion of the bottom of the door.

2. The door assembly of claim 1, wherein the transition weather barrier and the first weather barrier define a first air space, the door assembly further comprising a second side seal adapted to be secured substantially vertically between the first side portion of the door frame and the first door and to form a first water barrier between the first side portion of the door frame and the first door, the first water barrier being positioned in front of the first weather barrier and the first weather barrier and the first water barrier defining a second air space between the first weather barrier and the first water barrier, the first air space and the second air space being connected such that the first and second air spaces are adapted to substantially equilibrate in pressure.

3. The door assembly of claim 2, wherein the first side seal and the second side seal are a single, monolithic body, the first side seal being substantially dome shaped in cross-section when in a non-compressed state and the second side seal being substantially J-shaped in cross-section when in a non-compressed state.

4. The door assembly of claim 2, wherein the first side seal is spaced from the second side seal such that substantially all moisture passing the second side seal is drained along the first side portion of the door frame and prior to passing the first side seal.

5. The door assembly of claim 1, wherein the transition weather barrier has an upper portion and a lower portion, the upper portion connecting with the first weather barrier and positioned at a vertical gap from the bottom of the door and the lower portion being at a horizontal gap from the first weather barrier and connecting with the lower weather barrier.

6. The door assembly of claim 5, wherein the vertical gap is at least about 1 inch.

7. The door assembly of claim 5, wherein the vertical gap is from about 1 inch to about 4 inches.

8. The door assembly of claim 1, wherein the second side of the door is hinged to the second side portion of the frame.

9. The door assembly of claim 1, wherein the door assembly is an inswing door assembly.

10. The door assembly of claim 1, wherein the front of the door corresponds to an exterior facing side of the door assembly.

11. The door assembly of claim 1, wherein the transition weather barrier extends substantially arcuately between the first weather barrier and the lower weather barrier.

12. The door assembly of claim 1, wherein the lower seal is secured to the bottom of the door.

13. The door assembly of claim 1, wherein the first side seal is secured to the first side portion of the frame.

14. The door assembly of claim 1, wherein the transition seal is secured to the first side portion of the frame.

15. The door assembly of claim 1, wherein the transition seal extends past the bottom of the door.

16. A weather sealed door system comprising:

a door frame including first and second jambs, a header, and a sill;

a door having a front, a back, a first side, a second side, a top, and a bottom, the door being secured to the frame such that the back of the door defines an interior plane and the front of the door an exterior plane when the door is in a closed state;

a side seal positioned between the first side of the door and the door frame when the door is in the closed state to define a side weather seal along the first side of the door;

a bottom seal positioned along the bottom of the door and toward the back of the door such that when the door is in the closed state, the bottom seal contacts the sill of the door frame to define a lower weather seal along the bottom of the door toward the back of the door; and a transition seal positioned along the first side of the door when the door is in the closed state to define a transition weather seal along the first side of the door between the lower weather seal and the side weather seal, the transition seal having an upper portion and a lower portion, the upper portion being located at a first distance from the interior plane of the door and the lower portion being at a second distance from the interior plane of the door, the first distance being substantially greater than the second distance.

17. The system of claim 16, wherein the upper portion of the transition seal is located at a first height and the lower portion of the transition seal is located at a second height, the first height being substantially greater than the second height.

18. The system of claim 16, further comprising a frame, wherein the transition seal is compressed between the door and the frame when the door is in the closed state.

19. The system of claim 18, wherein the side seal is secured to the frame.

20. The system of claim 16, further comprising a passive door, wherein the transition seal is compressed between the door and the passive door when the door is in the closed state.

21. A door assembly comprising:

a frame including a top portion, a bottom portion, a first side portion, and a second side portion opposite the first side portion;

a door secured to the frame and having a top, a bottom, a first side, a second side opposite the first side, a front, and a back, the first side having a front portion toward the front of the door and a back portion toward the back of the door and the bottom having a front portion toward the front of the door and a back portion toward the back of the door;

a first side seal adapted to be secured substantially vertically between the first side portion of the door frame and the first side of the door and to contact the first side portion of the door frame and the first side of the door to form a first weather barrier toward the front portion of the first side of the door;

a lower seal adapted to be secured substantially horizontally between the bottom portion of the frame and the bottom of the door and to contact the bottom portion of the frame and the bottom of the door to form a lower weather barrier toward the back portion of the bottom of the door; and a first transition seal adapted to be secured between the first side portion of the door frame and the first side of the door and to contact the first side portion of the frame and the first side of the door to form a transition weather barrier extending between the first weather barrier and the lower weather barrier, the transition weather barrier extending substantially arcuately between the first weather barrier and the lower weather barrier.

* * * * *